United States Patent [19]

Dagenhart

[11] Patent Number: 4,531,077

[45] Date of Patent: Jul. 23, 1985

[54] ION SOURCE WITH IMPROVED PRIMARY ARC COLLIMATION

[75] Inventor: William K. Dagenhart, Oak Ridge, Tenn.

[73] Assignee: The United States of America as represented by the United States Department of Energy, Washington, D.C.

[21] Appl. No.: 562,147

[22] Filed: Dec. 16, 1983

[51] Int. Cl.[3] ..... H01J 7/24

[52] U.S. Cl. ..... 315/111.81; 250/426; 313/362.1; 315/111.31; 315/111.41

[58] Field of Search ..... 315/111.8, 111.3, 111.4; 250/423, 426; 313/362

[56] References Cited

U.S. PATENT DOCUMENTS

| | | | |
|---|---|---|---|
| 2,700,107 | 1/1955 | Luce | 250/426 |
| 2,903,586 | 9/1959 | Pressey | 250/426 |
| 3,326,769 | 6/1967 | Neidigh et al. | 176/4 |
| 3,678,334 | 7/1972 | Dugdale et al. | 315/111.81 |
| 4,447,761 | 5/1984 | Stinnett | 315/111.81 |

OTHER PUBLICATIONS

"Hot Electron Plasma Blanket" by V. J. Meece et al., ORNL 3908, UC-20 Report Oct. 31, 1965, pp. 62, 63.

Plasma Studies on a DuoPIGatron Ion Source by Tsai et al., pp. 649-655 Rev. Sci. Inst., vol. 48, No. 6, Jun. 1977.

*Primary Examiner*—Harold Dixon

*Attorney, Agent, or Firm*—David E. Breeden; Stephen D. Hamel; Judson R. Hightower

[57] ABSTRACT

An improved negative ion source is provided in which a self-biasing, molybdenum collimator is used to define the primary electron stream arc discharge from a filament operated at a negative potential. The collimator is located between the anode and the filament. It is electrically connected to the anode by means of an appropriate size resistor such that the collimator is biased at essentially the filament voltage during operation. Initially, the full arc voltage appears across the filament to collimator until the arc discharge strikes. Then the collimator biases itself to essentially filament potential due to current flow through the resistor thus defining the primary electron stream without intercepting any appreciable arc power. The collimator aperture is slightly smaller than the anode aperture to shield the anode from the arc power, thereby preventing the exposure of the anode to the full arc power which, in the past, has caused overheating and erosion of the anode collimator during extended time pulsed-beam operation of the source. With the self-biasing collimator of this invention, the ion source may be operated from short pulse periods to steady-state without destroying the anode.

4 Claims, 4 Drawing Figures

ION SOURCE WITH IMPROVED PRIMARY ARC COLLIMATION

This invention is a result of a contract with the United States Department of Energy.

BACKGROUND OF THE INVENTION

This invention relates generally to ion generators, and more specifically, to improvements that provide extended period operation at higher beam currents in a negative ion generator of the modified calutron type wherein negative ions are produced by surface ionization through the bombardment of a converter plate with positive ions of selected species produced in an electron arc discharge column.

In the art of negative ion production, one source of ion production is a modified calutron source employing the concept of surface ionization. One particular source of this type is the SITEX (Surface Ionization with Transverse Extraction) ion source. The SITEX ion source utilizes a hot filament arc discharge in a magnetic field to improve the gas efficiency of negative ion generation. The electron stream coming from the hot filament covers a larger area than is needed for generating the positive ions from selected molecular species, such as hydrogen or deuterium and cesium. The uncollimated electron power is dissipated on a graphite arc anode collimator, causing it to heat up to sublimation temperature. This, in turn, causes the collimator slot to erode very quickly and the ion source to fail prematurely. An additional disadvantage is that large quantities of carbon impurities are deposited on a cesium-coated, molybdenum ion converter plate, thereby raising the surface work function for the conversion of the positive ions to negative ions, and thus lowering the negative ion production efficiency.

In order to increase the ion source operating time, particularly to operate the source at steady state rather than in a pulsed mode, attempts were made to solve the problems associated with the graphite arc collimator. One attempt included designing a water-cooled molybdenum anode collimator. However, this has not been used, since during extended pulse periods the electron discharge power density $\sim 6KW/cm^2$) is too high for this arrangement to handle and the molybdenum collimator would melt during very short periods of operation. Thus, it will be appreciated that there is a need for an electron discharge collimator for use with the SITEX ion source which will allow the ion source to run short pulse to steady state.

SUMMARY OF THE INVENTION

In view of the above need, it is an object of this invention to provide an improved negative ion source which will sustain extended period operation.

Further, it is an object of this invention to provide an improved ion source as in the above object in which the electron discharge collimator does not introduce impurities into the system which contribute to the extracted negative ion beam impurities.

Other objects and many of the attendant advantages of the present invention will be obvious from the following detailed description of the preferred embodiment taken in conjunction with the drawings.

In summary, the improvement resides in the electron arc discharge collimation for a modified calutron type negative ion source in which surface ionization is employed to generate negative ions by bombarding a negatively biased converter plate with positive ions of selected species generated in an electron arc discharge column. The selected species, such as molecular hydrogen gas, is introduced into the arc column chamber to sustain ion generation. The column is in the form of a thin ribbon extending parallel to the converter plate. The negative ions are accelerated back through the ribbon column and focused by the electric field generated between the ion source anode electrode and the extraction electrode. The entire source is emersed in a magnetic field so that the flux lines extend parallel to and form the arc discharge column. The improved electron collimator according to the present invention includes a self-biasing molybdenum plate collimator disposed between a filament and a molybdenum anode. The molybdenum plate has an aperture, sized and shaped according to the desired shape and density of the arc discharge column which is slightly smaller than a corresponding anode aperture through which the column passes to a chamber containing the converter plate. The molybdenum plate collimator is made selfbiasing by electrically connecting the plate to the anode through a series resistor so that the collimator is initially biased at the anode potential. The resistor size is selected so that the plate collimator is biased at substantially the filament voltage when the arc discharge is established due to the limited current flow to the anode when the arc is established to form the discharge column. With this arrangement, the molybdenum collimator defines the primary electron stream without intercepting any appreciable arc power.

DETAILED DESCRIPTION OF THE PREFERRED EMBODIMENT

Figure 1:
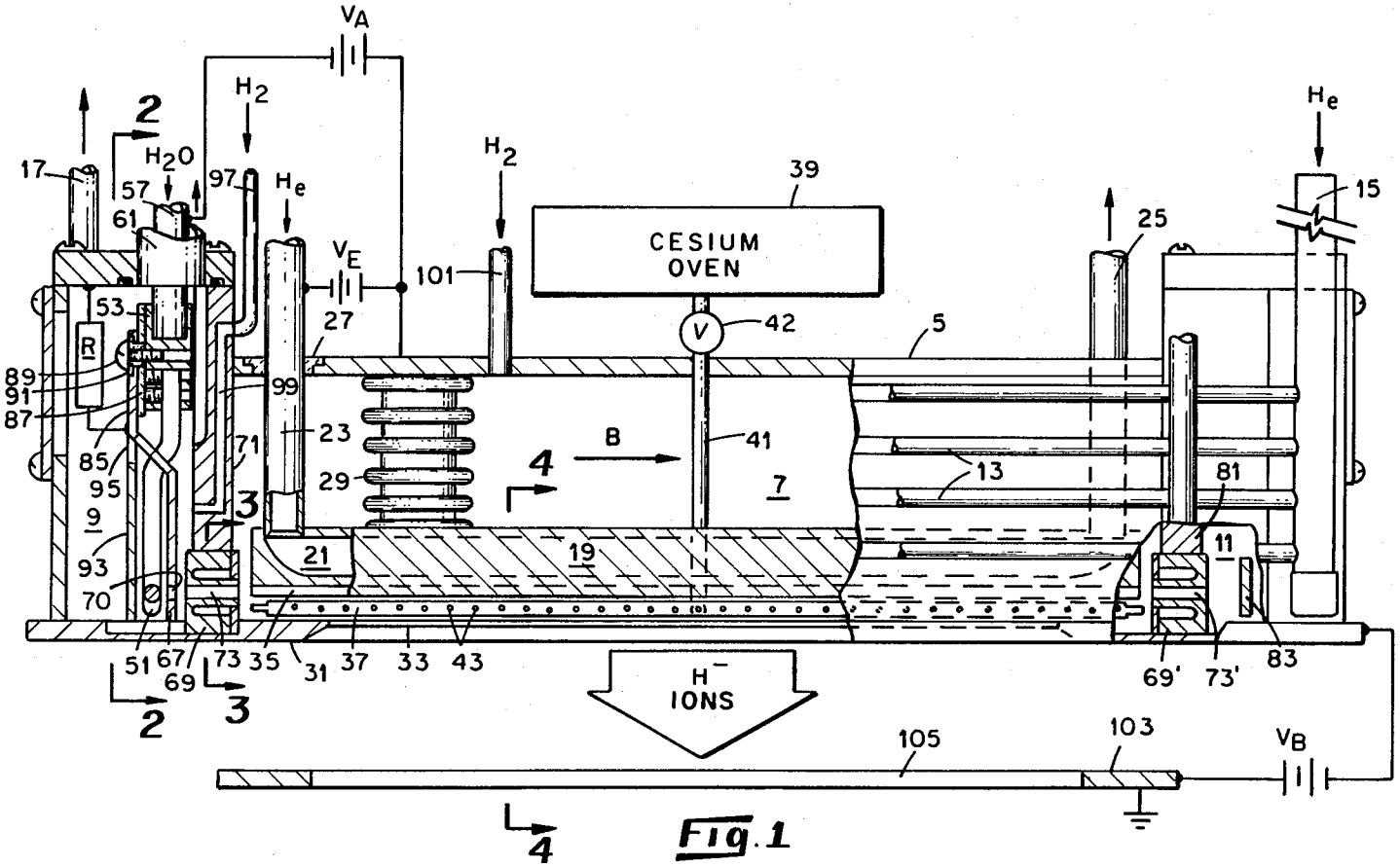
FIG. 1 is a partially schematic, top sectional view of a SITEX negative ion source including the improved primary electron beam collimator assembly according to the present invention.

Referring now to FIG. 1, there is shown a SITEX negative ion source submerged in a uniform magnetic field (B) and modified in accordance with the present invention. The ion source includes a housing 5, formed of a nonmagnetic metal, such as molybdenum, which encloses a converter chamber 7, a filament chamber 9, and a reflector chamber 11. The entire housing is cooled by means of coolant flow channels 13 which are partially embedded in the top and bottom walls of the housing 5 and are in fluid communication with intake manifolds 15 at one end of the housing and exhaust manifolds 17 (only the bottom side manifold is shown in FIG. 1) at the other end of the housing 5.

Figure 4:
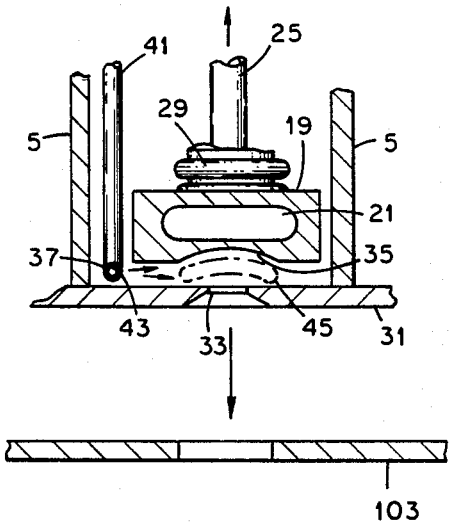
FIG. 4 is a section view taken along lines 4—4 of FIG. 1 showing the positive ion converter plate, plasma ribbon, and negative ion exit configuration.

A helium gas cooled, temperature controlled molybdenum ion converter plate 19 is located in the converter chamber 7. The plate 19 includes a double coolant channel 21 through which helium gas flows from an intake conduit 23 at one end of the converter plate 19 to an exhaust manifold 25 on the top at the other end of the converter plate 19. A counterflowing helium gas stream likewise cools the bottom half of coolant channel 21. The conduits 23 and 25 are electrically insulated from the housing by means of boron nitride insulator bushings 27 (only one of which is shown) where the conduits extend through the housing 5. The converter plate 19 is mounted by means of insulating supports 29 (only one shown) extending from the back side of the housing 5 so that the front converter surface is spaced close to the front face plate 31 of the housing 5 and aligned with an ion exit slot 33 located in the front face plate 31. The converting surface 35 of the ion converter plate 19 is concave in cross section in order to aid in focusing the negative ions generated at the converter surface for passage through the slot 33, as shown in FIG. 4 and in order to form a beam of small angular divergence. The converter surface 35 is coated with cesium to decrease the surface work function for the conversion of positive hydrogen ions ($H^+$) to negative hydrogen ions ($H^-$), as will be explained hereinbelow.

Cesium vapor is introduced into the chamber 7 in front of the converter surface 35 by means of a cesium vapor manifold 37 connected to a cesium oven 39 through an inlet conduit 41 and valve 42. The cesium vapor is uniformly introduced along the converter surface 35 through openings 43 spaced along the manifold 37 as shown in FIGS. 1 and 4. The purpose of the cesium vapor in the converter chamber is to coat the converter surface 35 with approximately $\frac{3}{4}$ of a monolayer coverage to minimize the surface work function. The cesium also forms $Cs^+$ions in the arc discharge, bombards the converter to produce $H^{31}$ ions.

The primary electron stream which forms the $H^+$and $Cs^+$plasma ribbon 45 extending parallel to and in front of the converter surface 35 of the converter plate 19, see FIG. 4, is generated in the filament chamber 9. A generally U-shaped filament 51 is held in place and insulated from the housing 5 by means of water-cooled filament holders 53 and 55, see FIG. 2. The filament holders 53 and 55 are water cooled by passing water through copper inlet conduits 57 and 59 which terminate in the filament holders 53 and 55, respectively. The water exits through openings in the inlet tubes into exit channels formed by exit conduits disposed concentrically about and insulated from the respective inlet conduits. The filament voltage is supplied through the inlet conduits 57 and 59, as shown schematically in FIG. 2, from a power source $V_F$ to the filament holders 53 and 55.

Figure 2:
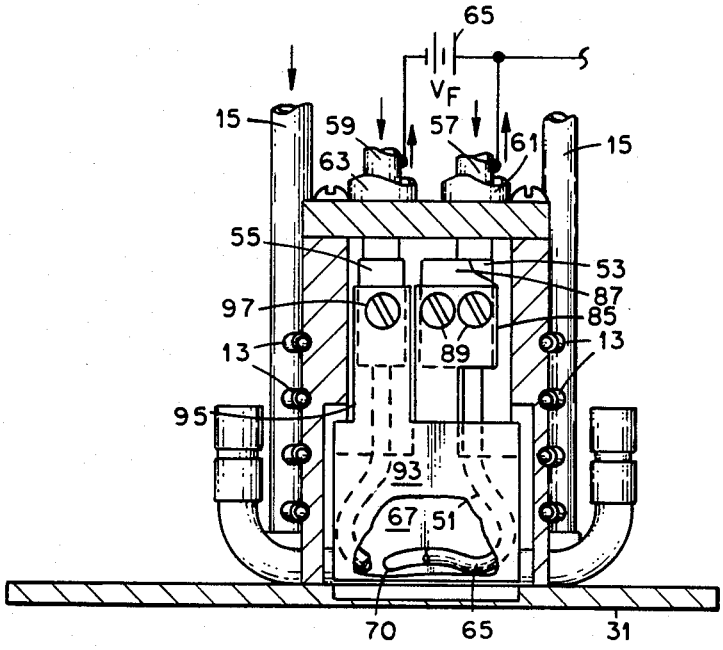
FIG. 2 is a section view taken along lines 2—2 of FIG. 1 showing the collimator plate and filament configuration.

Referring to FIG. 2, in order to form the $H^+$and $Cs^+$plasma ribbon 45, as shown in FIG. 4, the filament is contoured across its base portion 65 according to the desired plasma arc discharge ribbon cross section. This shape is controlled by a self-biasing arc collimator plate 67 having an aperture 70 which defines the discharge ribbon shape. The collimator plate 67 is formed from a molybdenum sheet having a thickness of about 1/16 inch. The plate 67 aperture is a curved oblong opening having a curvature corresponding to the curvature of the concave converter surface 35. The collimator plate is mounted between the filament 51 and the ion source anode 69 which forms a part of a partitioning wall 71 of the housing 5. The wall 71 isolates the filament chamber 9 from the converter chamber 7 of the ion source. The anode includes an oblong aperture 73, see FIG. 3, which has the same shape as the collimator aperture. The anode aperture 73 is slightly larger than the collimator aperture to prevent interception of the arc discharge from the filament which is collimated by the collimator aperture 70. The anode 69 is generally water cooled, as shown in FIG. 3, by passing water through an inlet conduit 75, through cooling channels 77 formed about the aperture portion of the anode 69 and out through an outlet conduit 79.

Figure 3:
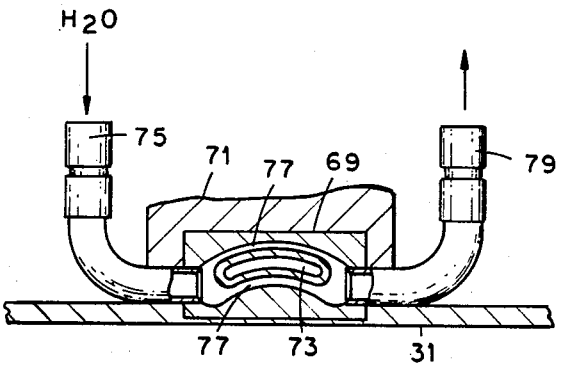
FIG. 3 is a section view taken along lines 3—3 of FIG. 1 showing the water-cooled anode configuration.

Another collimating anode arrangement 69', identical to the arrangement shown in FIG. 3, is located in a partition 81 of the housing 5 on the opposite side of the ion source from the anode 69. The partition 81 isolates the reflector chamber 11 from the converter chamber 7. A reflector plate 83 is mounted behind the anode 69', by means of insulators not shown, to intercept the arc discharge which passes through the anode 69' aperture 73' and reflects the arc back through the anode aperture 73' in a reflex discharge operating mode. The reflector 83 is formed of a molybdenum plate and will assume a negative charge which repels the electrons in the arc once the arc discharge is formed. The reflector can also be actively biased with a power supply. These reflected electrons are then recollimated by the ground potential operated anode collimator 69'.

Returning now to FIG. 2 in conjunction with FIG. 1, it will be seen that the arc collimator plate 67 is mounted by means of an upwardly extending tab portion 85 to the water-cooled filament holder 53. An insulator 87 is placed between the tab 85 and the filament holder and the tab 85 is secured to the holder by means of screws 89 extending through insulating bushings 91 in the tab 85 and threadably engaging the holder 53. The collimator plate 67 is connected electrically to the anode 69 through a resistor R connected between the collimator plate 67 and the housing 5 which is also operated at anode potential. An electron reflecting shield 93 formed of a molybdenum plate is positioned immediately behind the filament 51 and at filament potential. The shield 93 is mounted by attaching an upward extending portion 95 of the shield 93 to the filament holder 55 by means of a screw 97. The shield 93 and a portion of the filament base has been broken away in FIG. 2 in order to show the filament base 65 and collimator aperture 70 configuration.

In operation, the ion source employs a hydrogen/-cesium reflex discharge operating at approximately 100 volts and 30 amperes in a 1 kilogauss magnetic field B. Cesium vapor is admitted to the discharge from the cesium oven 39 through the manifold 37 along the discharge arc column in front of the cesiated converted surface 35 of the converter plate 19. The converter plate is biased at −100 Vdc by means of a power supply $V_E$ connected between the coolant inlet conduit 23 and the housing 5 which is operated at anode potential. In addition, hydrogen gas ($H_2$) is introduced into the converter chamber 7 through a hydrogen inlet tube 101. Positive cesium and hydrogen ions generated in the discharge ribbon 45 by collision with the electrons streaming along the magnetic field lines bombard the concave converter surface 35 and generate an intense flux of negative hydrogen ions. These negative ions are focused by the converter and forced to pass quickly through the thin discharge ribbon and out through the discharge slit 33 by means of a large accelerating voltage between the converter plate and the grounded accelerating electrode 103 surrounding the exit slit 33. The electrode 103 has an opening 105 through which the $H^-$ ions pass as they exit the ion source. The housing 5 is operated at typically −20 kVdc relative to the grounded acceleration electrode 103 by means of a power supply $V_B$ connected between the housing 5 and the accelerator electrode 103.

In order to form the plasma ribbon in which the positive ions are generated and avoid the erosion of the anode 69, which in the past has been formed of graphite, the collimator plate 67 is initially biased at the anode potential due to the connection of the resistor R between the collimator plate 67 and the housing 5. The filament 51 is biased negative, typically −150 Vdc relative to the anode 69, by means of a power supply $V_A$ connected between one leg of the filament 51 and the housing 5. Thus, the full arc voltage ($V_A$) appears across the filament to collimator plate 67 gap until the arc strikes. When the arc is established, the collimator plate biases itself to essentially filament potential due to the current flow to the anode from the filament through the collimator plate and the resistor R. The resistor value is selected to limit the anode current flow to about 0.3 amp with a resistance of 500 ohms. Since the collimator plate 67 is operated at filament potential, electrons are extracted only from the collimator plate 67 slot area 70. In this way, electrons which normally would be drawn from other hot emitting areas of the filament 51 are eliminated. Thus, the plate collimator is not subjected to any appreciable arc power. The collimator plate 67 is formed of molybdenum so that any sputtered material will compliment the converter 19 structure which is also formed of molybdenum. The slot 70 is shaped according to the desired arc column 45 form, in this case a thin curved ribbon shape and thereby defines the cross-sectional shape of the electron stream/positive ion arc discharge column.

As shown in FIG. 1, hydrogen gas is introduced into the filament chamber near the primary arc discharge area through an inlet conduit 97 connected to a flow channel 99 in the housing wall 71. Hydrogen is introduced into the filament chamber 9 for the purpose of establishing an intense arc discharge to supply ionizing electron to the $H^+/Cs^+$generator column 45.

Thus, it will be seen that the electrons are accelerated from the heated filament 51 through the collimator plate slot 70 by means of the anode 69. These electrons then stream along the magnetic flux lines (B) through the anode 69 opening 73 without being intercepted by the anode and are reflected by the electrically isolated reflector plate 83. Plasma is produced everywhere along the electron ribbon which is approximately 15 cm long, 1.3 cm wide, and 0.3 cm thick. The converter surface 35 is separated from the ribbon by about 0.1 mm. The power supply $V_E$ is used to accelerate positive ions generated in the ribbon onto the converter surface, thereby producing negative ions by means of surface ionization. These negative ions are then rapidly accelerated and pass back through the ribbon and out the front slit 33 by means of the negative ion extraction electrode 103.

Accordingly, it will be seen that with the improvements in a negative ion source provided by the present invention, the source may be operated for longer periods of time at higher arc currents without destroying the primary arc discharge anode, which has been the primary source life limitation in the past. This, in turn, allows higher negative ion currents to be produced from the same size source. Further, the improvement allows the electron collimator to be water cooled thereby lower the thermal cycling fatigue of the arc chamber parts.

Although the invention has been illustrated by means of a description of a single preferred embodiment, various modifications and variations of this invention will become apparent to those skilled in the art from the foregoing detailed description and the accompanying drawings. For example, the ion source is not limited to the production of negative hydrogen ions. Negative ions of other molecular species such as $D^-$, $T^-$, $C^-$, $0^-$, and $Li^-$may be produced by the ion source. Such modifications and variations are intended to fall within the scope of the appended claims.

I Claim:

1. In an ion source for generating negative ions from a selected molecular species wherein said selected species is introduced in a gaseous state into a converter chamber of a housing including a converter plate disposed within said converter chamber, said converter plate having an ion converter surface oriented in spaced relation to a negative ion exit opening in said converter chamber in a focusing arrangement with said ion converter surface, said converter being operated at a negative potential relative to said housing so that positive ions of said species generated in a plasma column extending over said converter surface within said chamber are accelerated onto said converter surface to convert said positive ions to negative ions of said species by means of surface ionization and extractor means for forcing said negative ions generated at said converter surface back through said plasma column and out said exit opening in said converter chamber, an electron arc discharge collimating system comprising:

a filament disposed in a filament chamber of said housing;

an anode structure forming a portion of a wall of said housing between said filament chamber and said converter chamber, said anode having an opening aligned with the longitudinal axis of said plasma column;

a collimator plate insulatably disposed between said filament and said anode, said collimating plate having an aperture therethrough aligned with said opening in said anode structure for collimating electrons emitted from said filament and accelerated through said aperture in said plate by said anode;

means for biasing said filament at a negative potential relative to said anode;

a resistor connected between said collimating plate and said anode, so that said collimator plate is initially biased at the anode potential, said resistor being of a value such that said collimator plate is self-biased at essentially the filament voltage during operation of said ion source so that said aperture in said collimator plate defines the primary electron stream for an arc discharge forming said plasma column by the collision of said electrons streaming through said collimating plate aperture and said anode from said filament with said molecular species along the length of said plasma column.

2. The combination as set forth in claim 1 wherein said collimator plate is formed of a molybdenum sheet and extends over the area of said filament to suppress emission of electrons from said filament outside of said collimator aperture area.

3. The combination as set forth in claim 2 further including a filament holder insulatably supported within said filament chamber for holding said filament and providing electrical connection thereto, a cooling means coupled with said holder for cooling said filament during operation of said ion source and wherein said collimating plate is electrically insulatably supported by said filament holder to provide cooling of said collimating plate.

4. The combination as set forth in claim 3 wherein said selected molecular species is Hhd 2.

* * * * *